US006355893B1

(12) United States Patent
Ikunami

(10) Patent No.: US 6,355,893 B1
(45) Date of Patent: Mar. 12, 2002

(54) PUSH-BUTTON APPARATUS

(75) Inventor: Takahiro Ikunami, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/712,924

(22) Filed: Nov. 16, 2000

(30) Foreign Application Priority Data

Jun. 12, 2000 (JP) ..... 2000-175928

(51) Int. Cl.[7] ..... H01H 21/24
(52) U.S. Cl. ..... 200/339; 200/557
(58) Field of Search ..... 200/5 R, 520, 200/553, 329, 339, 341, 343–345; 400/490, 491, 495, 496

(56) References Cited

U.S. PATENT DOCUMENTS 4,710,602 A * 12/1987 Baity et al. ..... 200/315
5,008,503 A * 4/1991 Stuhlmacher ..... 200/308
6,037,552 A * 3/2000 Yamada ..... 200/339
6,222,144 B1 * 4/2001 Nishikawa ..... 200/537

FOREIGN PATENT DOCUMENTS

JP 676693 3/1994 ..... H01H/25/04

* cited by examiner

*Primary Examiner*—Michael Friedhofer

(57) ABSTRACT

A push-button apparatus includes a main body having at least two inward walls parallel to each other and a push-button having two outward walls parallel to each other. The push-button is arranged within an inner space defined between the two inward walls of the main body. A recess is arranged at any one of the main body and the push-button. A rotation axis is arranged at the other of the main body and the push-button and rotatably fitted into the recess. A front end of the rotation axis pressingly comes into contact with a bottom of the recess by virtue of elastic return force derived from materials of the push-button.

6 Claims, 3 Drawing Sheets

PUSH-BUTTON APPARATUS

BACKGROUND OF THE INVENTION

1. Field of the Invention

The present invention relates to a push-button apparatus which can be rotated about a rotation axis, and which functions as a switching device.

2. Related Art

FIG. 1 is a front view showing a construction of a front panel of a car-audio apparatus. In the FIG. 1, reference numeral 1 denotes a slot. This slot 1 is formed at approximately central portion of a front panel (hereinafter referred to panel) P as a case body of the car-audio apparatus. The slot 1 is used to lead a plurality of compact discs (hereinafter referred to CDs) to a CD driving apparatus (not shown) in the car-audio apparatus. A plurality of push-buttons 2 are arranged at a portion beneath the slot 1 of the panel P. Each push-button 2 is used to select a required CD from the group of the CDs above.

The push-button 2 has a hinge offset from the center of symmetry. More specifically, as shown in FIG 2, the push-button 2 includes a box-type main body 3 having an upper portion functioned as an operation face 3*a,* both side-walls 3*b* and 3*c,* front wall 3*d* and rear wall 3*e.* A pair of bearing portions 4 are dangled from the lower part of the both side-walls 3*b* and 3*c,* respectively, near the rear wall 3*e.* Each bearing portion 4 has a bearing hole 4*a* as a center of rotation. The push-button 2 is, as shown in FIG. 4, arranged within a space defined between inside-walls SW of the panel P. As shown in FIG. 3, the panel P has a pair of rotation axes P1 in the space of the panel P. One axis P1 is extended to the other axis P1. Both axes P1 are rotatably arranged in the bearing hole 4*a* of bearing portion 4. Further, the panel P has a hole P2 which can be engaged with a claw portion 5. The claw portion 5 is dangled from the lower part of the front wall 3*d.* A lower end of the claw portion 5 is contact with a top of a member S1 of a switching mechanism S on a printing circuit board B arranged beneath the panel P. In case that the member S1 per se is made from elastic materials such as gums, the member S1 is upwardly urged by a return force on the basis of the elastic material. Alternatively, the member S1 may be upwardly urged by a return force on the basis of a spring (not shown) arranged in the switching mechanism S. In any case, the member S1 is upwardly urged in a direction of arrow Al as illustrated in FIG. 3 to elevate the claw portion 5 and to engage with the hole P2 of the panel P. One terminal (not shown) is arranged at a lower portion of the member S1, and the other terminal (not shown) is fixed on the printing circuit board B in the switching mechanism S. Both terminals (not shown) are away from each other by virtue of the urging force.

Movement of the push-button 2 will be described as follows:

When the upper portion of the main body 3 is downwardly pushed in a direction of arrow A2 of FIG. 3, the main body 3 is rotated in a direction of arrow A3 of FIG. 3 about the bearing portion 4 and the rotation axis P1 as the center of rotation. In this case, the member S1 of the switching mechanism S is downwardly pushed against the urging force by the claw portion 5 of the main body. As a result, the one terminal (not shown) of the member S1 comes into contact with the other terminal (not shown) to change over from "switch-on" to "switch-off" or the reverse.

Next, when pushing force subjected to the upper portion of the main body 3 is weakened or eliminated, the main body 3 is rotated by the urging force of the member SI in a direction of arrow A4 of FIG. 3. In this case, since the one terminal (not shown) of the member Si is elevated in the direction of arrow A1, the one terminal (not shown) is away from the other terminal (not shown) to change over from "switch-off" to "switch-on" or the reverse. Simultaneously, since the claw portion 5 is elevated by the urging force of the member S1 in the direction of arrow A1 to engage with the hole P2 of the panel P, the rotation of the main body 3 in the direction of arrow A1 is restricted by such engagement.

As shown in FIG. 4, it is however necessary to define a gap between the side-wall 3*b* or 3*c* of the main body 3 and the inside-walls SW of the panel P in order to rotate smoothly the push-button 2. Since the bearing portion 4 of the push-button 2 is slightly slid in a longitudinal direction on the rotation axis P1 of the panel P, the main body 3 comes into contact with the panel P on sliding. This contact makes operators feel that the push-button is unstable. As a result, there was a problem that reliability regarding the movement of switching was reduced.

SUMMARY OF THE INVENTION

Accordingly, it is an object of the present invention to provide a push-button apparatus having a high reliability regarding the movement of switching without coming into contact the main body with the panel.

According to a first aspect of the present invention we provide a push-button apparatus including a main body having at least two inward walls parallel to each other; a push-button having two outward walls parallel to each other, the push-button being arranged within an inner space defined between the two inward walls of the main body; a recess arranged at any one of the main body and the push-button; and a rotation axis arranged at the other of the main body and the push-button and rotatably fitted into the recess, wherein a front end of the rotation axis pressingly comes into contact with a bottom of the recess by virtue of elastic return force derived from materials of the push-button.

According to a second aspect of the present invention we provide a push-button apparatus above, wherein a sliding-resistance member is arranged at least any one of the front end of the rotation axis and the bottom of the recess.

According to a third aspect of the present invention we provide a push-button apparatus above, wherein a tapered projecting part is arranged at any one of the front end of the rotation axis and the bottom of the recess, and wherein the tapered projecting part is positioned at a central line of the rotation axis.

DESCRIPTION OF THE PREFERRED EMBODIMENT OF THE INVENTION

One embodiment according to the present invention will be described as follows:

Embodiment 1

Figure 5:
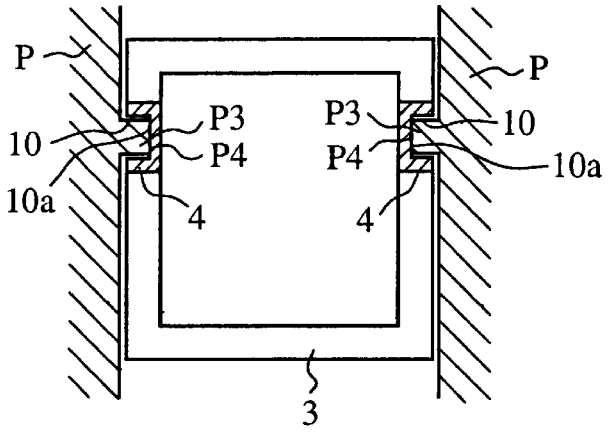
FIG. 5 is a cross sectional view showing cruxes of a push-button apparatus according to embodiment 1 of the present invention.

FIG. 5 is a cross sectional view showing cruxes of a push-button apparatus according to embodiment 1 of the present invention. Common numerals denote common elements of Embodiment 1 to elements of the conventional push-button apparatus, and the description of that parts are omitted.

In this embodiment 1, a recess 10 is arranged at the respective outside surfaces of the bearing portions 4. The rotation axis P3 of the panel P is rotatably fitted into the recess 10. A front end P4 of the rotation axis P3 pressingly comes into contact with a bottom 10*a* in the recess 10 by virtue of elastic return force derived from materials of the bearing portion 4.

The recess 10 has an inner diameter little larger than outer diameter of the rotation axis P3, and the bottom 10 of the recess 10 has a plain face. The front end P4 of the rotation axis P3 of the panel P also has a plain face. The front end P4 in the Embodiment 1 is made of a sliding-resistance member such as polyacetals and so on in order to reduce or control the sliding resistance in rotation between the rotation axis P3 and the recess 10. In this case, the panel P is formed by molding resin materials such as polycarbonates or acrylonitrile-butadiene-styrene copolymer. The front end P4 of the rotation axis P3 is made by two-layer forming.

Figure 3:
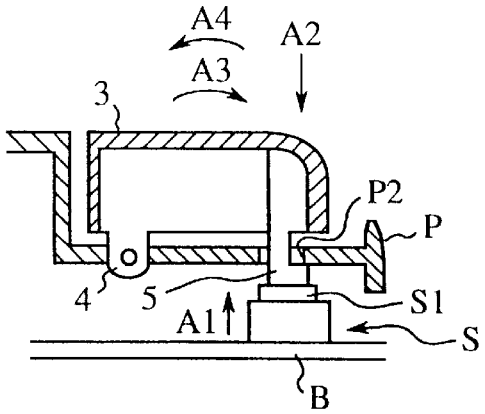
FIG.3 PRIOR ART
FIG. 3 is a cross sectional view taken along lines III—III of FIG. 2.
Figure 4:
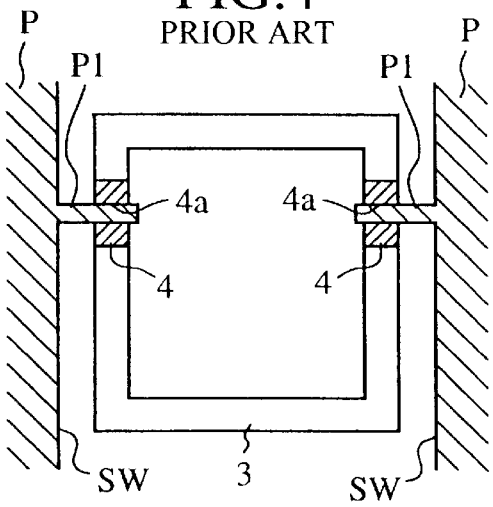
FIG.4 PRIOR ART
FIG. 4 is a cross sectional view taken along lines IV—IV of FIG. 2.

Movement will be described as follows:

It should be noted that elements are explained in reference to FIG. 3 because the elements are common to another elements of the switching mechanism S.

When the upper portion of the main body 3 is downwardly pushed in a direction of arrow A2 of FIG. 3, the front end P4 of the rotation axis P3 of the panel P is rotationally slid with the bottom 10*a* of the recess 10 of the bearing portion 4 of the main body 3. The front end P4 and the bottom 10*a* function as the center of rotation, and the main body 3 is rotated in the direction of arrow A3 about the center of rotation. In this case, since the claw portion 5 goes down in the direction of arrow A2 against the urging force derived from the member S1 in the switching mechanism S, one terminal (not shown) of the member S1 comes into contact with the other terminal (not shown) to change over from "switch-on" to "switch-off" or the reverse.

Next, when pushing force subjected to the upper portion of the main body 3 is weakened or eliminated, the front end P4 of the rotation axis P3 of the panel P is rotationally slid with the bottom 10*a* of the recess 10 of the bearing portion 4 of the main body 3. The front end P4 and the bottom 10*a* function as the center of rotation, and the main body 3 is rotated in the direction of arrow A4 about the center of rotation. In this case, since one terminal (not shown) of the member S1 goes up in the direction of arrow A1, one terminal (not shown) is away from the other terminal (not shown) to change over from "switch-off" to "switch-on" or the reverse. Simultaneously, since the claw portion 5 is elevated by the urging force of the member S1 in the direction of arrow A1 to engage with the hole P2 of the panel P, the rotation of the main body 3 in the direction of arrow A1 is restricted by such engagement.

As described above, in this embodiment 1, the front end P4 of the rotation axis P3 pressingly comes into contact with the bottom 10*a* of the recess 10 by using elastic return force derived from materials of the bearing portion 4. The generation of sliding of the rotation axis P3 in the axial direction can be therefore repressed. Position of the rotation axis P3 and the recess 10 can be also stable and reliability regarding the movement of switching can be increased.

In this embodiment 1, the bearing portion 4 having the recess 10 is provided at the main body 3 and the rotation axis P3 is provided at the panel P. Alternatively, the bearing portion 4 may be oppositely arranged at the panel P and the rotation axis P3 may be arranged at the main body 3. In this case, the elastic return force derived from the bearing portion can be used for pressing of the rotation axis toward the bottom of the recess.

In this embodiment 1, the front end P4 of the rotation axis P3 is made of polyacetal as the sliding-resistance member. Alternatively, grease may be provided between the front end P4 of the rotation axis P3 and the bottom 10*a* of the recess 10 in order to reduce the sliding-resistance therebetween. Crimps such as wrinkles or unevenness may be formed at least one of the front end P4 of the rotation axis P3 and the bottom lOa of the recess 10 in order to control the sliding-resistance.

Embodiment 2

Figure 6:
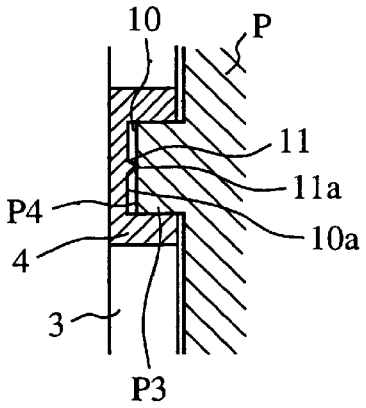
FIG. 6 is an enlarged cross sectional view showing a push-button apparatus according to embodiment 2 of the present invention.

FIG. 6 is an enlarged cross sectional view showing a push-button apparatus according to embodiment 2 of the present invention. Common numerals denote common elements of Embodiment 1 to elements of the conventional push-button apparatus, and the description of that parts are omitted.

In the embodiment 2, a conical-shaped tapered projecting part 11 is provided at the central portion of the bottom 10*a* of the recess 10. The rotation axis P3 of the panel P is rotatably fitted into the recess 10. A front end 11*a* of the tapered projecting part 11 provided on the bottom 10*a* of the recess 10 pressingly comes into contact with the front end P4 at a central point positioned on a central line of the rotation axis P3 by virtue of elastic return force derived from materials of the bearing portion 4.

In other words, in the embodiment 1 the bottom 10*a* of the recess 10 and the front end P4 of the rotation axis P3 of the panel P are rotatably slid in plain face. Alternatively, in the embodiment 2, the tapered projecting part 11 pressingly comes into contact with the central point of the front end P4 of the rotation axis P3 with only one point. The sliding-resistance in rotation of the embodiment 2 is therefore lower than that of the embodiment 1.

As described above, according to the embodiment 2, the front end 11*a* of the tapered projecting part 11 provided on the bottom 10*a* of the recess 10 pressingly comes into contact with the front end P4 at the central point positioned on a central line of the rotation axis P3. The generation of sliding of the rotation axis P3 in the axial direction can be therefore repressed. Position of the rotation axis P3 and the recess 10 can be also stable and reliability regarding the movement of switching can be increased. Since the sliding-resistance in rotation can be further reduced, push-button operation can be smoothly performed.

In the embodiment 2, the tapered projecting part 11 is provided on the bottom 10*a* of the recess 10. Alternatively, the tapered projecting part 11 may be oppositely arranged at the front end P4 of the rotation axis P3 of the panel P. In the embodiment 2, the tapered projecting part 11 has a conical shape. Alternatively, the projecting part 11 may be tapered so as to pressingly come into contact with any one of the center of rotation of the front end P4 or the bottom 10*a* with only one point. For example, the projecting part may have a conic-polygonal shape.

Figure 1:
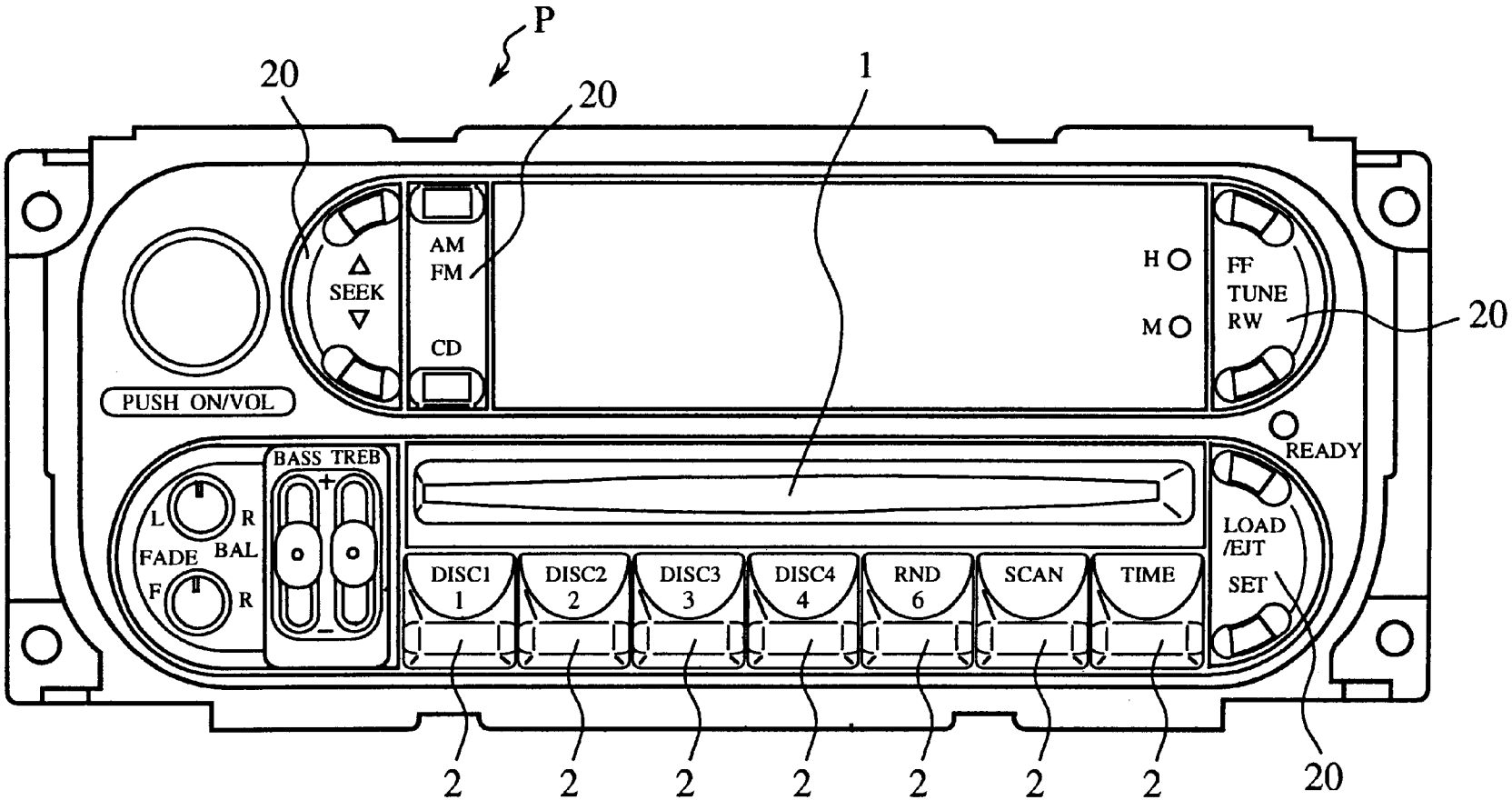
FIG. 1 is a front view showing a construction of a front panel of a car-audio apparatus.
Figure 2:
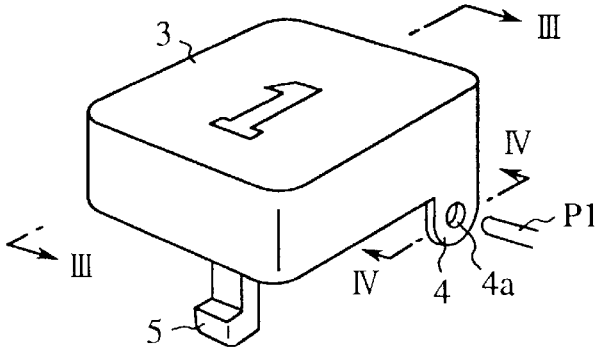
FIG.2 PRIOR ART
FIG 2 is a perspective view showing an outward appearance of a conventional push-button having an offset hinge, which can be used to the car-audio apparatus shown in FIG. 1.
Figure 7:
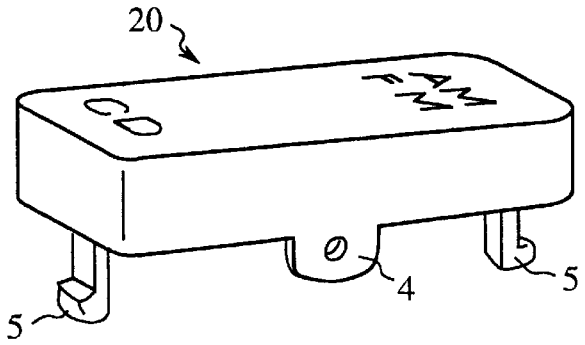
FIG. 7 is a perspective view showing an outward appearance of a seesaw type of push-button for which the push-button apparatus of the present invention is suitable.

The respective push-buttons 2 in the embodiments 1 and 2 are applicable for the offset-hinge type push-button 2 as shown in FIG. 1. Alternatively, the push-button apparatus according to the present invention may be applicable for a push-button 20 as a seesaw-type push-button apparatus as shown in FIG. 7. The push-button 20 is suitable for selecting a plurality of the matters such as drive of the CDs or tune in to AM or FM station. The push-button 2 is common to the offset-hinge type push-button 2 except that the bearing portion 4 as the center of rotation is positioned at a central position of the main body.

As described above, in the present invention, the front end of the rotation axis pressingly comes into contact with the bottom of the recess by using elastic return force derived from materials of the bearing portion. The generation of sliding of the rotation axis in the axial direction can be therefore repressed. Position of the rotation axis and the recess can be also stable and reliability regarding the movement of switching can be increased.

In the present invention, the sliding-resistance member is arranged at least any one of the front end of the rotation axis and the bottom of the recess. The sliding-resistance in rotation can be therefore reduced or controlled.

In the present invention, the tapered projecting part is arranged at any one of the front end of the rotation axis and the bottom of the recess, and the tapered projecting part is positioned at the central line of the rotation axis. The generation of sliding of the rotation axis in the axial direction can be therefore repressed. Position of the rotation axis and the recess can be also stable and reliability regarding the movement of switching can be increased. Since the sliding-resistance in rotation can be further reduced, push-button operation can be smoothly performed.

The present invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A push-button apparatus, comprising:

a main body having at least two inward walls parallel to each other;

a push-button having two outward walls parallel to each other, the push-button being arranged within an inner space defined between the at least two inward walls of the main body;

a recess arranged at any one of the main body and the push-button; and a rotation axis arranged at the other of the main body and the push-button and rotatably fitted into the recess, wherein a front end of the rotation axis pressingly comes into contact with a button of the recess by virtue of elastic return force derived from materials of the push-button.

2. A push-button apparatus according to claim 1, wherein a sliding-resistance member is arranged at least any one of the front end of the rotation axis and the bottom of the recess.

3. A push-button apparatus according to claim 1, wherein a tapered projecting part is arranged at any one of the front end of the rotation axis and the bottom of the recess, and wherein the tapered projecting part is positioned at a central line of the rotation axis.

4. A push-button apparatus, comprising:

a main body having at least two inward walls parallel to each other, the two inward walls defining an inner space therebetween;

a push-button having two outward walls parallel to each other, the push-button being disposed within the inner space;

a recess located at one of the main body and the push-button, the recess having a bottom surface located therein in a plane perpendicular to a longitudinal axis; and an axis portion located at the other of the main body and the push-button, the axis portion having an end surface perpendicular to the longitudinal axis, the axis portion rotatably fitted into the recess such that the push-button rotates about the longitudinal axis and at least one of the bottom surface and the end portion is configured with a contact surface having an elastic return force derived from materials thereof, the axis portion pressingly contacting the bottom surface through the at least one contact surface based on the elastic return force.

5. A push-button apparatus according to claim 4, wherein at least one of the end portion and the bottom surface is configured with a sliding-resistance member.

6. A push-button apparatus according to claim 5, wherein at least one of the end portion and the bottom surface is configured with a tapered projecting part, wherein the tapered projecting part is centrally positioned along the longitudinal axis.

* * * * *